US006460211B1

(12) United States Patent
Chapman

(10) Patent No.: US 6,460,211 B1
(45) Date of Patent: Oct. 8, 2002

(54) APPARATUS FOR OZONATING A DRY CLEANING MACHINE AFTER A SOLVENT CYCLE AND METHOD THEREOF

(76) Inventor: Robert J. Chapman, 296B Woodview Rd., Barrington, IL (US) 60010

( * ) Notice: Subject to any disclaimer, the term of this patent is extended or adjusted under 35 U.S.C. 154(b) by 79 days.

(21) Appl. No.: 09/587,869

(22) Filed: Jun. 6, 2000

(51) Int. Cl.[7] ..... D06B 5/08

(52) U.S. Cl. ..... 8/158; 8/159; 62/13 R; 62/183; 62/17 R

(58) Field of Search ..... 68/13 R, 183, 68/207, 17 R, 18 R; 8/158, 159

(56) References Cited

U.S. PATENT DOCUMENTS

| | | | | |
|---|---|---|---|---|
| 2,009,365 | A | * | 7/1935 | Wait |
| 3,065,620 | A | | 11/1962 | Houser |
| 3,130,570 | A | | 4/1964 | Rentzepis |
| 3,194,628 | A | | 7/1965 | Cannon |
| 5,195,252 | A | | 3/1993 | Yamada |
| 5,241,720 | A | | 9/1993 | Engel |
| 5,404,732 | A | | 4/1995 | Kim |
| 5,493,743 | A | | 2/1996 | Schneider |
| 5,511,264 | A | | 4/1996 | Nishioka |
| 5,625,915 | A | | 5/1997 | Radler |
| 5,806,120 | A | | 9/1998 | McEachern |
| 5,940,988 | A | * | 8/1999 | Eisen |
| 5,960,501 | A | | 10/1999 | Burdick |
| 5,960,649 | A | | 10/1999 | Burdick |
| 6,272,770 | B1 | * | 8/2001 | Slutsky et al. |

* cited by examiner

*Primary Examiner*—Frankie L. Stinson
(74) *Attorney, Agent, or Firm*—Charles F. Meroni, Jr.; Meroni & Meroni, P.C.

(57) ABSTRACT

This invention concerns a ozone injector system for injecting ozone into a dry cleaning machine after a solvent cycle has completed while recirculating solvent residual gas that has gravitated outside the dry cleaning machine. The invention comprises an ozone generator, an ozone injection assembly and a controller. The ozone generator is slideably positioned next to the dry cleaning machine while the ozone injection assembly is flexably connected to the ozone generator. The ozone injector assembly comprises a solenoid solvent valve and a solenoid ozone valve which are connected to each other by fixtures and communicate with each other via the controller to inject ozone after the solvent flow. The ozone generator further recirculates heavier than air solvent gas which gravitates outside the dry cleaning machine upon opening after the ozone cycle.

24 Claims, 5 Drawing Sheets

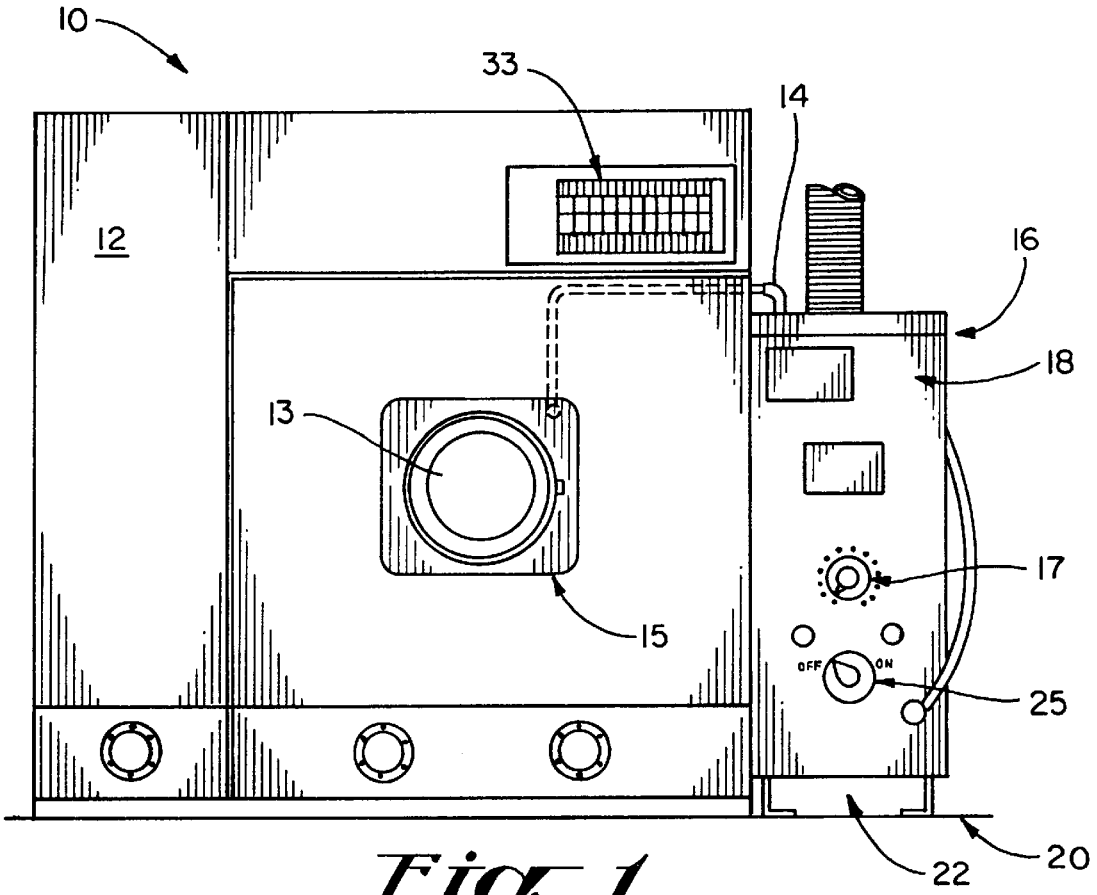
Fig. 1
Fig. 2
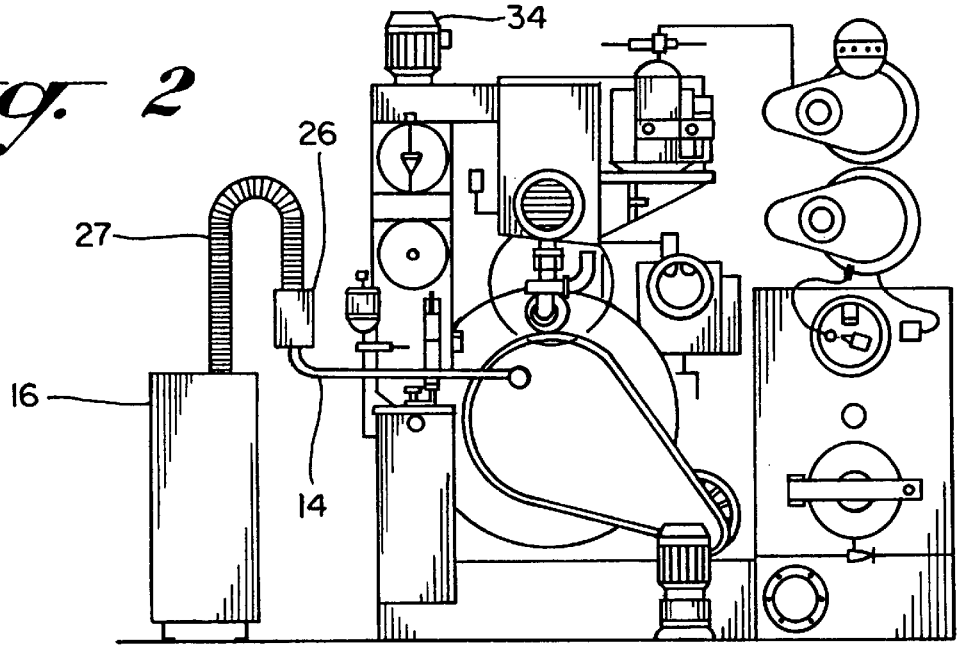

APPARATUS FOR OZONATING A DRY CLEANING MACHINE AFTER A SOLVENT CYCLE AND METHOD THEREOF

BACKGROUND OF THE INVENTION

1. Field of the Invention

The present invention relates to an electro mechanical device to inject ozone into a dry cleaning machine which uses organic solvent such as perchloroethylene. More specifically, my invention is primarily intended to provide a user such as a dry cleaning employee a system to inject ozone in a closed loop into a dry cleaning machine to eliminate odors and gas such as perchloroethylene gas in a convenient, economical and environmentally safe way. The present invention can be utilized with an existing dry cleaning machine or can be utilized with the construction of a new dry cleaning machine. The present invention also relates to a method of injecting ozone into a dry cleaning machine after the solvent cycle to eliminate any residual perchloroethylene gases left in the wheel housing and to recirculate any residual perchloroethylene gas that has gravitated outside the wheel housing.

2. Description of the Prior Art

The utilization of ozone in the washing and dry cleaning business is well known. Ozone is a molecule consisting of three oxygen atoms which a triatomic allotrope of oxygen which consist of two oxygen atoms. When oxygen is passed through an electrical field, the electrical field breaks apart the oxygen molecules into free atoms. These singular oxygen atoms then bond to oxygen atoms to form ozone molecules.

When ozone comes in contact with odors, oxidation reoccurs, resulting in the elimination of the odors and the release of oxygen. As formed, ozone is a positively charged molecule which attracts to negatively charged molecules such as organic and hydrocarbon stains found in greases, fats and oils. When the ozone is injected into a cleaning solvent, it reacts chemically with the stains causing the stains to break up into smaller pieces. Further, ozone acts as a bactericide and is the strongest oxidant commercially available with results thousands of times faster than chlorine. Additionally, ozone eliminates odor causing bacteria by cell lysing where the ozone molecule molecularly ruptures the bacteria membrane destroying the bacteria in a matter of seconds. This process eliminates the bacteria and thus prevents any ozone resistant strains from forming. Chlorine on the other hand takes up to thirty to sixty minutes to eliminate the bacteria.

Accordingly, ozone is commonly used in the wash and dry clean industry as the ozone efficiently breaks down organic compounds resulting in less cleaning chemicals used in the cleaning operation. Thus, the use of ozone in the cleaning industry produces a number of significant environmental benefits and cost savings as less chemical results in less pollutants and less production costs. With the beneficial properties of ozone, however, come hazards. Ozone is highly toxic when directly exposed to humans. OSHA regulates that the maximum allowable limit for an eight hour period is 0.10 parts per million. Utilization of ozone in the cleaning industry typically results in off gases of the ozone in that all the ozone is not used and dispenses into the air. Ozone, fortunately, however is not a stable gas and breaks down into oxygen in about thirty minutes in open air.

In the dry cleaning industry, a solvent is used to clean the load of articles as opposed to a wash system. In a wash system, water is treated with a cleaning chemical which then in turn washes the load of articles such as clothing. Today, the common solvent presently used is perchloroethylene hereinafter referred as "perc." Perc is an exceptionally effective solvent as it dissolves virtually all organic stains, including oils, greases, fats and waxes resulting in minimized need for pre-spotting and re-working. Perc penetrates fibers quickly and dissolves soils resulting in shorter cleaning cycles.

Perc is chemically and thermally stable under normal conditions of use but it does require proper handling and use. Exposure to continual and extremely high vapor concentrations can cause severe depression of mental functions, respiratory failure and even death. Further, prolonged and repeated contact will cause rough and dry skin leading to infection. Also, if swallowed, perc may cause serious liver effects and possibly death. Further, perc may be cancer causing. In fact, the State of California, under California Proposition 65 has listed perc as a chemical known to the state to cause cancer.

As such, steps need to be taken to reduce exposure to perc. In the dry cleaning operations, the door to the wheel housing should be closed at all times except when transferring a load of articles. When a wheel housing door is opened, residual perc gases gravitates to the floor as perc is heavier than air. Thus perc is not readily diluted in the air but exists in the room. Further, utilizing a closed loop system should be used to limit exposure as a closed loop does not expose the solvent to the air. After the dry clean step in most cycles, perc residue remains on the clothes as the deodorizing step does not terminate all perc. Thus, a customer will bring perc back to their home. Accordingly, public exposure should be minimized by cutting down on residual perc in cleaned garments.

In the present state of the art, a dry cleaning system and method does not exist to inject ozone directly into a wheel housing after the solvent cycle to reduce perc residue gas remaining on the load of articles. Further, in the present state of the art, a system does not exist to reduce off gases such as perc that travels outside the wheel housing when the door is opened. The state of the art is such that present dry cleaning equipment and methods utilize ozone to clean during the solvent cycle.

In U.S. Pat. No. 5,511,264 issued to Nishioka discloses a method for deodorizing and refreshing for dry cleaning. This invention uses a solvent such as perc in a dry cleaning apparatus having a cleaning bath, a solvent storage tank and a circulating pump. The components are interconnected so that the perc is pumped from the solvent storage tank by the circulating pump to be supplied to the cleaning bath through the path and the solvent is returned from the cleaning path to the solvent storage tank. In this method, an ozone generating device injects ozone directly into the solvent as fine bubbles. The ozone generating device injects ozone into the bottom of the solvent tank by using a diffuser where the diffuser spreads the ozone uniformly into the solvent. Thus, the load of articles is cleaned with ozonated solvent during the solvent cycle. After, the solvent cycle, the load of articles is dried and removed from the machine. The ozonated solvent is returned through filters to the solvent storage tank.

Limitations exist, however, with this system and method of deodorizing for dry cleaning. Although the ozonated solvent is filtered for reuse, the method still leaves perc residue on the load of articles as the perc is mixed with the solvent. Thus, the public has exposure of perc as it remains on clothes to be brought back. Further, the system and method leaves off gas ozone and perc gas residue inside the clean bath of the dry clean machine. Thus, when a door to the clean bath is opened, perc gas residue will gravitate near the floor surface exposing users in the room as the system and method does not draw this gas residue to an ozone generator to be recirculated.

U.S. Pat. 5,195,252 issued to Yamada discloses a method for dry cleaning as well as a method for recovery of solvent. In this method, an open system is used where outside air is brought into a treating drum of a dry cleaning machine. After the contents of the treating drum are treated with a solvent such as perc, the treating drum is stopped. An upper opening located in the treating drum is then opened. Simultaneously, a lower opening located at the bottom of the treating drum is slowly opened and exhausts the solvent into a treating tank. Thus, the solvent is replaced during this open cycle with the outside air.

This method, too, contains limitations. First, the system is an open system which is not recommended for perc use in the dry cleaning industry as perc may escape into the room. This open system exposes the perc gas residue to the environment without drawing it back for recirculation. Second, the system does not utilize ozone to terminate the perc gas. Accordingly, the open system leaves the perc gas residue on the articles that were sent through the deodorizing cycle.

U.S. Pat. No. 's 5,625,915, 5,806,120 and 5,960,501 disclose ozonated laundry systems. These systems are utilized with a water wash cycle as opposed to a dry clean cycle which utilizes solvent instead of water. Each of these systems injects ozone from an ozone generator directly into the wash cycle where the ozone diffuse into the water. Thus, the ozone is mixed with the wash cycle and drained out of the washing machine via either a recirculation circuit or to a drain. These systems do not address any reduction in ozone off gassing or other gas residue as the systems are utilized in a washing machine whereas the present invention injects ozone separately after the solvent cycle.

What is needed then is a means for eliminating perc gas residue remaining on the articles that have dry cleaned while further eliminating perc gas residue and ozone off gas remaining in the dry clean machine. Further, what is needed is a means for eliminating perc gas residue which gravitates toward a floor surface when the dry cleaning machine is opened.

It would become highly economical and beneficial for environmental issues and safety concerns to eliminate the residue of solvent gas remaining on articles that have been dry cleaned.

It would also become highly advantageous for environmental and health concerns to circulate and eliminate solvent gas residue which has gravitated outside the dry cleaning machine and exposed inside a room.

Accordingly, it is a principal object of my invention to provide a system and device to eliminate the residue of solvent gas remaining on articles that have been dry cleaned.

It is a further object of my invention to provide a system and method to circulate and eliminate the solvent gas residue which has been released upon opening the dry cleaning machine.

Other objects of my invention, as well as particular features, elements, and advantages thereof, will be elucidated in, or apparent from, the following description and the accompanying drawing figures.

SUMMARY OF THE INVENTION

According to my present invention I have provided an ozone injector system for injecting ozone in a closed loop to a dry cleaning machine which comprises a dry cleaning machine having a wheel housing therein for receiving a load of articles to be cleaned. The wheel housing is threadably connected to a transfer line which injects solvent into the wheel housing from a solvent source means located nearby.

An ozone generator which is slideably positioned adjacent to the dry cleaning machine is provided. The ozone generator directly injects ozone into the wheel housing for eliminating odors and solvent gas residue such as perchloroethylene remaining inside the wheel housing. Perchloroethylene gas is the preferred solvent utilized in the dry cleaning industry. The ozone generator comprises an enclosure assembly which is supported at a substantial height above a floor surface allowing a circulation space for drawing perchloroethylene gas residue which has gravitated outside the wheel housing through an air filter. The air filter is positioned on the bottom of the enclosure assembly for filtering the air and perchloroethylene gas residue drawn up from the floor surface.

My invention further comprises an ozone injector assembly flexably positioned by a flex tube to inject ozone and solvent into the wheel housing from the ozone generator. The ozone injector assembly further comprises a solenoid ozone valve which is threadably connected to the flex tube for controlling the ozone flow into the wheel housing. The ozone injector assembly further comprises a solenoid solvent valve which is threadably connected to the transfer line for controlling solvent flow. The solenoid ozone valve and solenoid solvent valve are threadably connected to each other by a tee fixture which is threadably connected to the wheel housing by the transfer line for injecting solvent and ozone into the wheel housing. A gas sensor is located inside the wheel housing to monitor the amount of ozone and solvent.

A controller is utilized for electrically communicating with the ozone injector assembly for activating the solvent solenoid valve and the ozone solenoid valve for controlling the solvent flow and ozone flow. The controller automatically signals the ozone generator to vary the ozone depending on contamination of the load of articles. Further, a cooling fan is utilized where the cooling fan is fixably mounted on top of the dry cleaning machine. The cooling fan is connected to the wheel housing for translating air to the wheel housing for cooling the wheel housing where the cooling fan is electronically controlled by the controller.

I have also provided a method of using an ozone injection system to inject ozone in a closed loop to a dry cleaning machine and to draw residual gases off the dry cleaning machine, the method comprising multiple steps. The user selects a solvent selection on a controller from a plurality of solvent selections and initiates a solvent cycle corresponding to the solvent selection. The solvent cycle then injects solvent into a wheel housing. The user then terminates the solvent cycle corresponding to contamination of a load of articles to be dry cleaned and begins injecting ozone from the ozone generator. The ozone is injected by an ozone injector assembly directly into the wheel housing after the solvent cycle and the cooling cycle. Before ozone injection though, the controller transmits a solvent signal from the controller to close a solenoid solvent valve to stop solvent flow into the wheel housing while simultaneously transmits an ozone signal from the controller to open a solenoid ozone valve to inject ozone into the wheel housing. The user then can vary the ozone production from an ozone generator corresponding to the load of articles to be dry cleaned either automatically by the controller or manually by the user. The controller can determine an ozone level and a solvent gas level by the controller in the wheel housing and transmit a production signal from the controller to vary a gas sensor the ozone production from the ozone generator.

The controller then transmits a cool signal from the controller to a cooling motor to introduce air and to cool the wheel housing before the ozone is being injected. Upon completion of the cooling, the user then terminates the cooling motor and the ozone production. Next, the user opens a door of the wheel housing to unload the load of articles while allowing any heavier than air perchloroethylene gas residue to gravitate near a floor surface. The user then activates the ozone production to draw the perchloroethylene gas residue that has gravitated toward the floor surface into the ozone generator to recirculate the perchloroethylene residue gas. The controller closes the solenoid ozone valve to prevent any ozone or perchloroethylene gas residue to be injected. A fan of the ozone generator is then activated to circulate the fallen perchloroethylene gas residue after termination of the ozone production to further reduce perchloroethylene gas residue.

DESCRIPTION OF THE DRAWINGS

Other features of my invention will become more evident from a consideration of the following detailed description of my patent drawings, as follows:

FIG. 1 is a front view of a dry cleaning machine with a controller along with a an ozone generator positioned slideably adjacent showing the transfer line;

FIG. 2 is a back view of the dry cleaning machine where the ozone generator is flexably connected to the back of the wheel housing;

DETAILED DESCRIPTION OF THE PREFERRED EMBODIMENT

Figure 5:
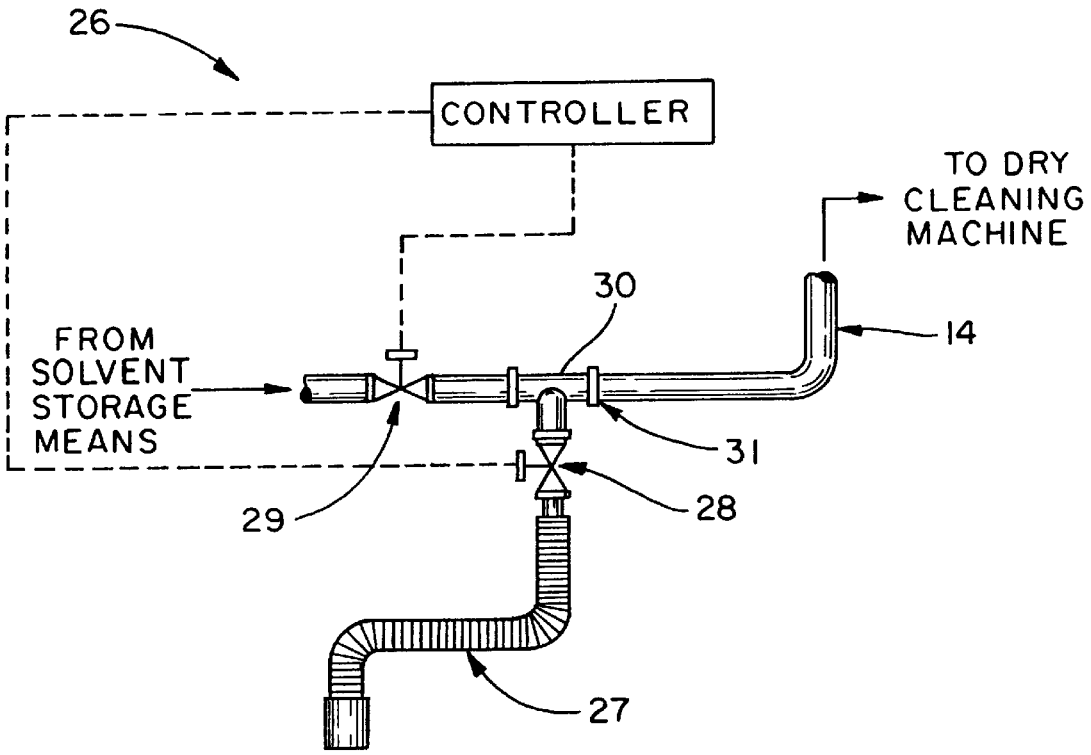
FIG. 5 is a side view of the ozone injector assembly showing the flex tube connected to the solenoid ozone valve, the tee fixture perpendicularly spacing the solenoid ozone valve and the solenoid solvent valve, the controller and the transfer line.

Referring now to the drawings, my preferred embodiment of my invention, as shown in FIG. 1, is an ozone injector system 10 which injects ozone directly into a wheel housing 13 of a dry cleaning machine 12 after a solvent cycle has terminated while further drawing and eliminating perchloroethylene gas residue which gravitates outside an opened door 15 of the wheel housing 13. The ozone injector system 10 can be built in with a new dry cleaning machine 12 and it can be economically and efficiently connected to an existing dry cleaning machine 12. Key features of my invention, as shown in FIGS. 1, 2, & 5 are the ozone generator 16 and the ozone injection assembly 26.

In the dry cleaning industry, a solvent is used to clean the load of articles as opposed to a wash system. Today, the solvent presently used is perchloroethylene although the present invention can perform the operation on any solvent used. Perchloroethylene is an exceptionally effective solvent as it dissolves virtually all organic stains, including oils, greases, fats and waxes resulting in minimized need for pre-spotting and re-working. Perc is chemically and thermally stable under normal conditions of use but it does require proper handling and use. Exposure to continual and extremely high vapor concentrations can cause severe depression of mental functions, respiratory failure, possible cancer and even death. Further, prolonged and repeated contact will cause rough and dry skin leading to infection. Also, if swallowed, perchloroethylene may cause serious liver effects and possibly death.

As such, steps need to be taken to reduce exposure to perchloroethylene. In the dry cleaning operations, the door 15 to the wheel housing 13 should be closed at all times except when transferring a load of articles. When a door 15 is opened, residual perchloroethylene gases gravitates to the floor as perchloroethylene is heavier than air. Thus perchloroethylene is not readily diluted in the air but sustains in the room. Further, perchloroethylene residue remains on the load of articles such as clothes which the consumer brings home.

As shown in FIG. 1, excellent results are obtained when an ozone injector system 10 is connected to a dry cleaning machine 12. In a standard dry cleaning machine 12, solvent such as perchloroethylene is injected into the wheel housing 13 during the solvent cycle to clean the load of articles. In a standard dry cleaning machine 12, the solvent is supplied by a solvent supply means and is injected into the wheel housing 13 via a transfer line 14.

In the present invention, an ozone generator 16 is slideably positioned adjacent to the dry cleaning machine 12. Excellent results are obtained when the ozone generator 12 utilized is a SONOZAIRE ™. The ozone generator 16 is slideably positioned as the present invention next to the dry cleaning machine 12 as the present invention can be connected to a new dry cleaning machine 12 and can be efficiently connected to an existing dry cleaning machine 12.

Figure 3:
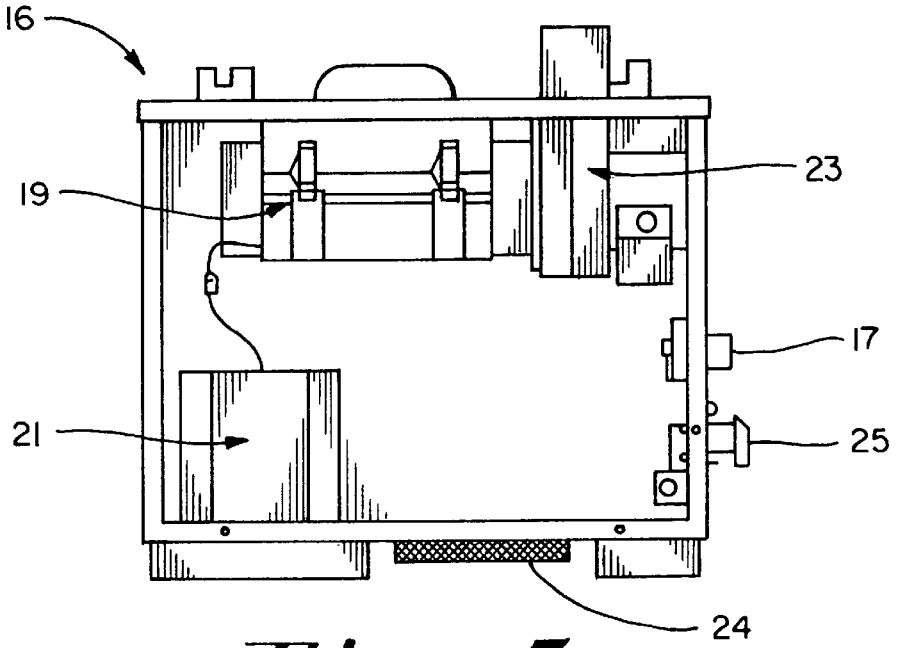
FIG. 3 is a sectional view of ozone generator showing the air filter located on the bottom and the circulating space located above the floor surface.

The ozone generator 16 comprises an enclosure assembly 18, a transformer 21, an electrode 19, an ozone fan 23, an air filter 24, a manual ozone control means 17 and a timer 25 as shown in FIG. 3. The ozone fan 23 draws gases such as air and other residual off gases from the dry cleaning machine 12 inside the enclosure assembly 18 through the air filter 24. The ozone fan 24 draws the air through the air filter 24. The ozone fan 24 draws the air through the electrode 19 where the transformer 21 provides the electric charge. When the electrode 19 is charged, the air inside the electrode 19 converts to ozone which exits the enclosure assembly 18.

In order to draw air or to circulate ozone off gas or any other gas such as perchloroethylene gas residue, the enclosure assembly 18 is supported above a floor surface 20. Thus, the air filter 24 is located on the bottom of the enclosure assembly 18. Excellent results are obtained when the enclosure assembly 18 is supported one to three inches above the floor surface 20 as shown in FIGS. 1 and 2.

In order to transfer ozone from the ozone generator 16, an ozone injector assembly 26 is utilized. The ozone injector assembly 26 comprises a flex tube 27, a solenoid ozone valve 28, a solenoid solvent valve 29, a tee fixture 30 with an outlet 31 as shown in FIGS. 2 and 5. The ozone injector assembly 26 is electronically controlled by a controller 33 such as a programmable controller or computer interfaced with the electronics and controls of the dry cleaning machine 12.

Figure 4:
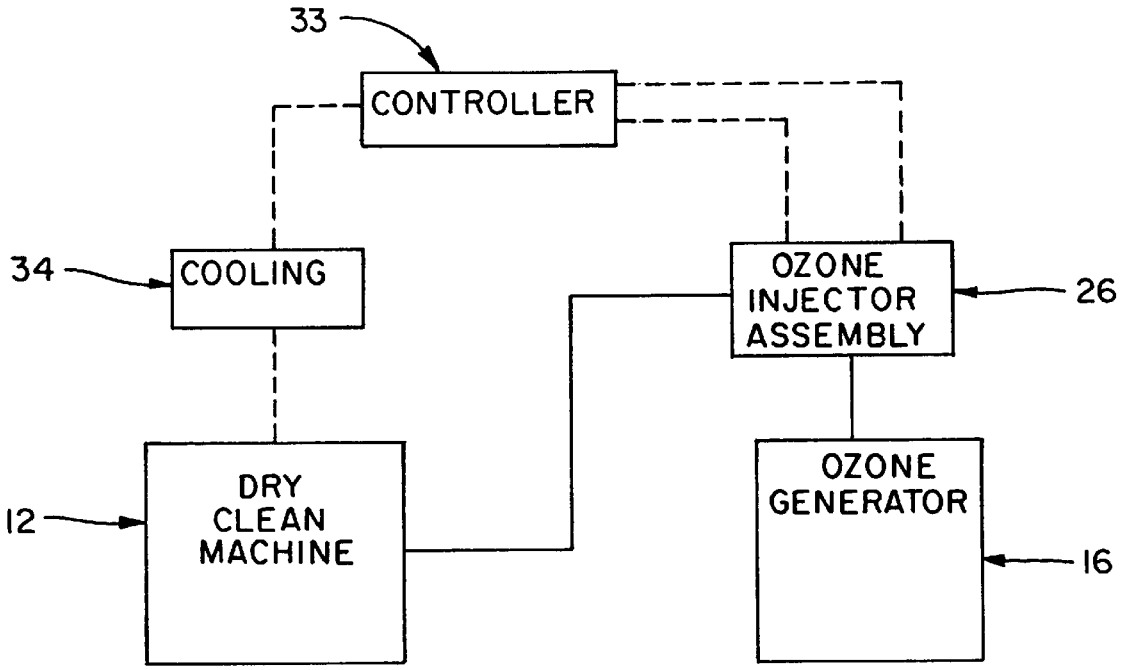
FIG. 4 is a schematic of the system showing the ozone injector assembly and cooling motor connected to the controller.
Figure 7:
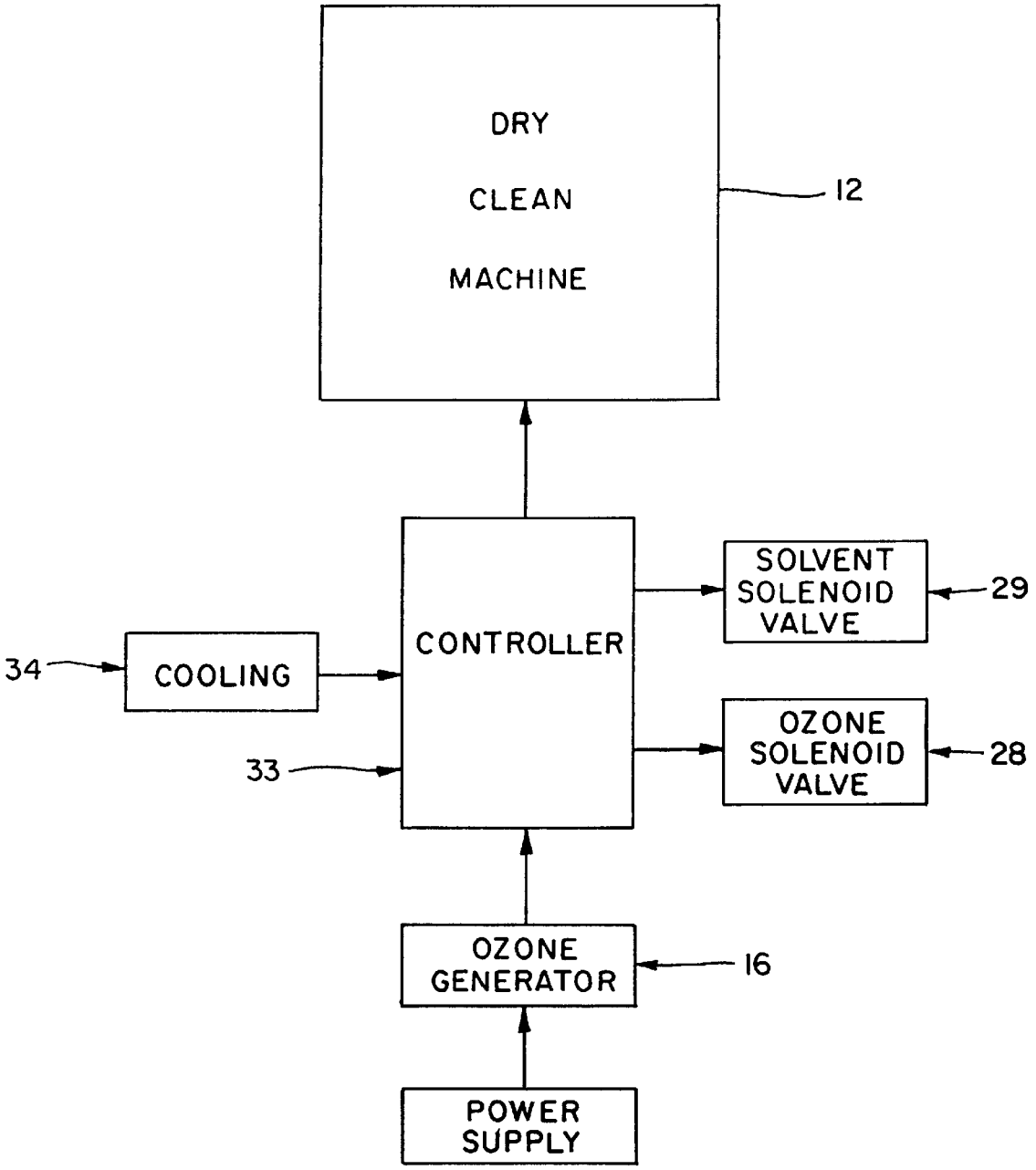
FIG. 7 is a schematic view of the elements such as the solenoid ozone valve and the solenoid solvent valve controlled by the controller.

During the solvent cycle, the solenoid solvent valve 29 is open to allow solvent to travel from the solvent source means (not shown) through the transfer line 14 to the wheel housing 13. Upon termination of the solvent cycle, the controller 33 sends a signal to the solenoid solvent valve 29 to close stopping the solvent flow. Simultaneously, the controller 33 sends a signal to the solenoid ozone valve 28 open as shown in FIGS. 4 and 7. When opened, the ozone travels from the ozone generator through a tee fixture 30 and on to the transfer line 14 and directly into the wheel housing 13. The tee fixture 30 perpendicularly spaces the solenoid solvent valve 29 and solenoid ozone valve 28 allowing the transfer line 14 to come off an outlet 31 of the tee fixture 30. Thus, the transfer line 14 can transfer solvent and ozone in one line into the wheel housing 13 as shown in FIGS. 2,4 and 5. Excellent results are obtained when the transfer line 14 connects at the top of the wheel housing 13. This positioning prevents gravity to collect solvent in the transfer line 14 causing blockage as shown in FIG. 2.

Figure 6:
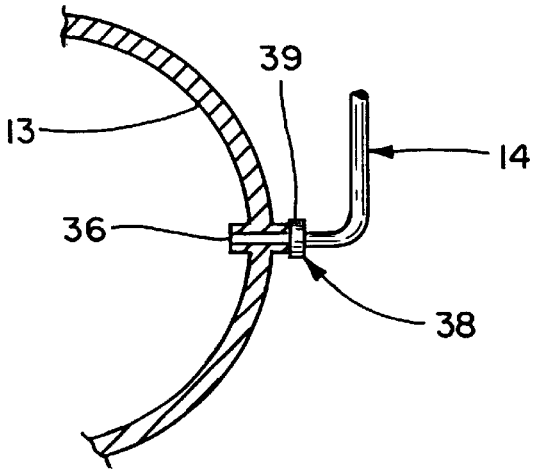
FIG. 6 is a cut away view of the wheel housing showing the existing nipple machined into the wheel housing and the transfer line connected to the existing nipple.

The present invention can economically be installed to a new dry cleaning machine 12 by hard piping the transfer line 14 from the ozone generator 16 into the wheel housing 13. Excellent results can also be obtained by adding the present invention to an existing dry cleaning machine 12. In most existing dry cleaning machines 12, an existing nipple 36 is machined into the back of the wheel housing 13 for auxiliary use as shown in FIG. 6. If not used, the existing nipple 36 is capped. However, the present invention can economically and efficiently be connected to the existing nipple 36. The transfer line 14 conveniently connects to the existing nipple 36 to inject solvent or ozone into the wheel housing 13.

In an automatic zone, the controller 33 sends a signal to the ozone generator 16 to vary ozone production depending on contamination of the load of articles. Excellent results can also be achieved by manually controlling ozone production. Located on the ozone generator 16, is a manual ozone control means 17 which the user can dial ozone production manually.

Prior the ozone cycle, the controller 33 sends a signal to a cooling fan 34. The cooling fan 34 is fixably mounted on the dry cleaning machine 12. The cooling fan 34 connects to the wheel housing 13 for translating air to the wheel housing 13 in order to cool the load of articles. As shown in FIG. 6, a gas sensor 35 is removably mounted inside the wheel housing to detect the amount of gas such as ozone and perchloroethylene. If the detected amount of gas is safe, the gas sensor 35 will signal to a door 15 of the wheel housing 13 to unlock. Thus, the user will not be exposed to the amount of gas as the door 15 is opened.

Figure 8:
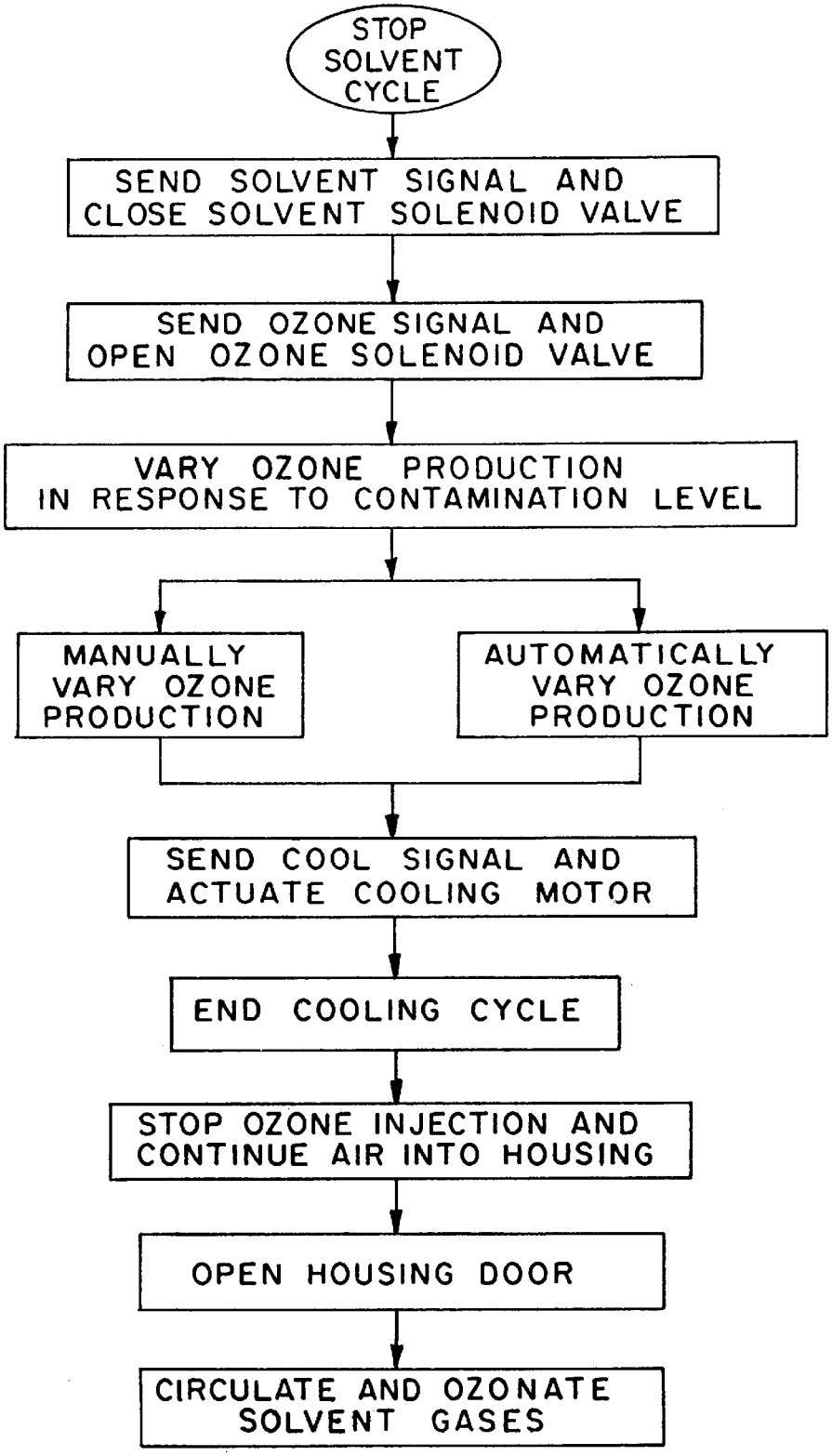
FIG. 8 is a flow diagram of the method steps of activating an ozone generator and an ozone injector assembly after the solvent cycle is completed.

I also disclose a method of using the ozone injection system to inject ozone in a closed loop after a solvent cycle and to recirculate off gases in a dry cleaning machine as shown in FIG. 8. In this method, the user can either use the ozone injection assembly with a newly built dry cleaning machine and can be used in an existing dry cleaning machine.

The user connects the transfer line 14 to an existing nipple 36 in the wheel housing 13 if the dry cleaning machine 12 is not presently connected. The user then selects a solvent selection on a controller from a plurality of solvent selections. The solvent selections correspond to different types of solvents and the lengths of the solvent cycles. The solvent selection corresponds to the amount of the load of articles to be cleaned and the contamination of the load of articles to be decontaminated. The controller 33 can either be programmable and built into the dry cleaning machine 12 and can also be hard wired separately to the dry cleaning machine 12 depending on the model.

The user then initiates a solvent cycle corresponding to the solvent selection by injecting solvent such as perchloroethylene solvent into a wheel housing 13. The solvent is stored in a solvent storage means attached to the dry cleaning machine 12. After the contamination of the load of articles is decontaminated by the solvent, the solvent cycle is terminated. The solvent cycle is terminated by transmitting a solvent signal from the controller to close a solenoid solvent valve to stop solvent flow into the wheel housing 13.

The controller 33 then transmits a cool signal to a cooling fan 34 to introduce air or cooling the load of articles prior to the ozone being injected. Upon termination of the solvent cycle and the cooling cycle, the user injects ozone from the ozone generator 16 by an ozone injector assembly 26 directly into the wheel housing 13. Ozone is entered by transmitting an ozone signal from the controller 33 to open a solenoid ozone valve 28 to inject ozone into the wheel housing 13. While the solenoid ozone valve 28 is opened, the user can vary ozone production from an ozone generator 16 corresponding to contamination of the load of articles to be dry decontaminated where the ozone production merges the perchloroethylene gas solvent to purge the same. The user can automatically and manually vary the ozone production. In the automatic mode, the controller 33 determines the ozone level in the wheel housing 13 and transmits a production signal depending on the contamination. The user can also manually vary the ozone by dialing an ozone control means 17 which is directly wired to the ozone generator 16. A gas sensor 35 detects the ozone or solvent left inside the wheel housing 13 before allowing the door 15 of the wheel housing 13 to be opened by the user.

The user then opens the door 15 of the wheel housing 13 to unload the load of articles. While the door 15 is opened any heavier than air perchloroethylene gas residue left inside the wheel housing 13 will gravitate toward a floor surface 20. At this stage, perchloroethylene gas residue exists in the room, thus, the user activates the ozone generation by activating an ozone fan 23 located inside the ozone generator 16 to draw the perchloroethylene gas residue which has gravitated near the floor surface 20 into the ozone generator 16 to further attack the perchloroethylene residue gas. As the ozone generator is positioned slideably adjacent to the dry cleaning machine, the ozone fan 23 can draw in the perchloroethylene gas residue without any arcing as the perchloroethylene gas residue is not sufficient enough to cause arcing. During this step, the controller 33 closes the solenoid ozone valve 28 to prevent any recirculated perchloroethylene gas residue and to ozone to be reinjected into the wheel housing 13.Further at this stage, the cooling fan 34 can circulate air into the wheel housing 13 now empty to further reduce ozone off gases remaining therein.

As various possible embodiments may be made in the above invention for use for different purposes and as various changes might be made in the embodiments and methods above set forth such as adding other sensors where applicable to monitor dry cleaning functions, it is understood that all of the above matters here set forth or shown in the accompanying drawings are to be interpreted as illustrative and not in a limiting sense.

I claim:

1. An ozone injector system for injecting ozone in a closed loop to a dry cleaning machine comprising:

a dry cleaning machine, the dry cleaning machine defining a wheel housing therein for receiving a load of articles to be cleaned, the wheel housing threadably connected to a transfer line, the transfer line injecting solvent into the wheel housing from a solvent source;

an ozone generator, the ozone generator slideably positioned adjacent to the dry cleaning machine for directly injecting ozone into the wheel housing for eliminating odors and perchloroethylene gas residue remaining inside the wheel housing, the ozone generator comprising an enclosure assembly, the enclosure assembly supported at least three inches above a floor surface allowing a circulation space for drawing perchloroethylene gas residue through an air filter, the air filter positioned on the bottom of the enclosure assembly for filtering the air and perchloroethylene gas residue drawn up from the floor surface;

an ozone injector assembly, the ozone injector assembly flexably positioned to inject ozone and solvent into the wheel housing from the ozone generator, the ozone injector assembly flexably connected to the ozone generator by a flex tube, the ozone injector assembly comprising a solenoid ozone valve, the solenoid ozone valve threadably connected to the flex tube for controlling the ozone flow into the wheel housing, the ozone injector assembly further comprising a solenoid solvent valve, the solenoid solvent valve threadably connected to the transfer line for controlling solvent flow, the solenoid ozone valve and solenoid solvent valve threadably connected to each other by a tee fixture, the tee fixture having an outlet threadably connected to the wheel housing by the transfer line for injecting solvent and ozone into the wheel housing;

a controller, the controller electrically communicating with the ozone injector assembly for activating the solvent solenoid valve and the ozone solenoid valve for controlling the solvent flow and ozone flow;

a gas sensor, the gas sensor removably mounted inside the wheel housing for detecting an amount of gas present therein and for determining a door signal based on the amount of gas present; and a cooling fan, the cooling fan fixably mounted on top of the dry cleaning machine, the cooling fan connected to the wheel housing for translating air to the wheel housing for cooling the wheel housing, the cooling fan being electronically controlled by the controller.

2. The ozone injector system of claim 1, wherein the transfer line is supportably mounted to enter at the top of the wheel housing for preventing gravity to collect solvent and ozone in the transfer line.

3. The ozone injector of claim 1, wherein the controller automatically signals the ozone generator to vary the ozone depending on contamination of the load of articles.

4. An ozone injector system for injecting ozone in a closed loop to a dry cleaning machine comprising:

an ozone generator, the ozone generator slideably positioned adjacent to an existing dry cleaning machine for directly injecting ozone into the dry cleaning machine, the ozone generator generates ozone for eliminating odors and gas residue remaining in the existing dry cleaning machine, the ozone generator being supported at a substantial height above a floor surface for drawing gas residue circulating about the floor surface;

an ozone injector assembly, the ozone injector assembly flexably connected to the ozone generator for injecting ozone and solvent into the existing dry cleaning machine, the ozone injector assembly comprising a solenoid ozone valve, the solenoid ozone valve threadably connected to a flex tube for controlling the ozone flow into the dry cleaning machine, the ozone injector assembly further comprising a solenoid solvent valve, the solenoid solvent valve threadably connected to the solvent source for controlling the solvent flow into the existing dry cleaning machine;

a gas sensor, the gas sensor removably mounted inside the wheel housing for detecting an amount of gas present therein and for determining a door signal based on the amount of gas present; and a programmable controller, the programmable controller being electronically connected for controlling the solvent solenoid valve and the ozone solenoid valve for controlling the solvent flow and the ozone flow.

5. The ozone injector assembly of claim 4, wherein the ozone generator has a manual ozone control means, the manual ozone control means manually controls the ozone depending on the contamination of the load of articles to be cleaned.

6. The ozone injector assembly of claim 4, wherein the substantial height of the ozone generator is at least an inch for drawing gas residue which gravitates about the floor surface when the existing dry cleaning machine is opened.

7. The ozone injector assembly of claim 4, wherein the solenoid ozone valve and the solenoid solvent valve are threadably connected to each other by a tee fixture, the tee fixture perpendicularly spaces the solenoid ozone valve and the solenoid solvent valve away from each other preventing any interference with the existing dry cleaning machine.

8. The ozone injector assembly of claim 7, wherein the tee fixture threadably connects to the existing dry cleaning machine by an existing nipple, the existing nipple being machined into a wheel housing of the dry cleaning machine for allowing entry therein.

9. The ozone injector assembly of claim 4, wherein the programmable controller signals the ozone generator to automatically vary ozone depending on the contamination of the load of articles.

10. The ozone injector assembly of claim 4, wherein the programmable controller signals an existing cooling fan, the existing cooling fan simultaneously operates to cool the existing dry cleaning machine while the solenoid ozone valve is open.

11. An ozone injector system for injecting ozone in a closed loop to a dry cleaning machine comprising:

dry cleaning means for receiving and for dry cleaning a load of articles utilizing a solvent supplied by a solvent means;

ozone generating means for generating ozone and for drawing perchloroethylene gas residue off the dry cleaning means;

ozone injector means for injecting ozone from the ozone generating means and for injecting solvent from the solvent means directly into the dry cleaning means;

controlling means for controlling the ozone injector means depending on the load of articles; and cooling means for cooling the load of articles.

12. The ozone injector system of claim 11, wherein the dry cleaning means comprises a dry cleaning machine, the dry cleaning machine defining a wheel housing therein for receiving the load of articles to be cleaned, the wheel housing threadably connected to a transfer line, the transfer line injecting solvent into the wheel housing from the solvent means.

13. The ozone injector system of claim 11, wherein the ozone generating means comprises an ozone generator, the ozone generator is slideably positioned adjacent to the dry cleaning machine for directly injecting ozone into the wheel housing for eliminating odors and perchloroethylene gas residue remaining inside the wheel housing, the ozone generator comprising an enclosure assembly, the enclosure assembly supported at least three inches above a floor surface over a circulation space, the circulation space allows for drawing perchloroethylene gas residue through an air filter.

14. The ozone injector system of claim 11, wherein the ozone injector means comprises an ozone injector assembly, the ozone injector assembly is flexably positioned to inject ozone and solvent into the wheel housing from the ozone generator, the ozone injector assembly is flexably connected to the ozone generator by a flex tube, the ozone injector assembly comprises a solenoid ozone valve, the solenoid ozone valve threadably connected to the flex tube for controlling the ozone flow into the wheel housing, the ozone injector assembly further comprising a solenoid solvent valve, the solenoid solvent valve threadably connected to the transfer line for controlling solvent flow, the solenoid ozone valve and solenoid solvent valve threadably connected to each other by a tee fixture, the tee fixture having an outlet threadably connected to the wheel housing by the transfer line for injecting solvent and ozone into the wheel housing.

15. The ozone injector system of claim 11, wherein the controlling means comprises a controller, the controller electrically communicating with the ozone injector assembly for activating the solvent solenoid valve and the ozone solenoid valve for controlling solvent flow and ozone flow.

16. The ozone injector system of claim 11, wherein the cooling means comprises a cooling fan, the cooling fan fixably mounted on top of the dry cleaning machine, the cooling fan having connected to the wheel housing for translating air to the wheel housing for cooling the wheel housing, the cooling fan being electronically controlled by the controller.

17. A method of using an ozone injection system to inject ozone after a solvent cycle in a closed loop to a dry cleaning machine and to draw residual gases off the dry cleaning machine, the method comprising the steps of:

a. selecting a solvent selection on a controller from a plurality of solvent selections;

b. initiating a solvent cycle corresponding to the solvent selection by injecting perchloroethylene solvent into a wheel housing;

c. terminating the solvent cycle corresponding to the degree of contamination of a load of articles to be decontaminated;

d. transmitting a cool signal from the controller to a cooling motor to introduce air to the decontaminated load of articles for cooling the same preparatory for removal from the wheel housing;

e. injecting ozone from the ozone generator by an ozone injector assembly directly into the wheel housing after the solvent cycle;

f. varying ozone production from the ozone generator corresponding to the degree of contamination of the load of articles to be decontaminated and merging the ozone production with the perchloroethylene gas solvent to cleanse the load of articles to be decontaminated;

g. terminating the cooling motor and the ozone production; and h. opening a door of the wheel housing to unload the load of articles while allowing any heavier than air perchloroethylene gas residue to gravitate outside the wheel housing toward a floor surface.

18. The method of claim 17, wherein, the ozone generator is activated to draw the perchloroethylene gas residue which has gravitated near the floor surface into the ozone generator to merge the ozone with the perchloroethylene residue gas to purge the same.

19. The method according to claim 18, wherein the step of injecting ozone comprises the steps of:

a. transmitting a solvent signal from the controller to close a solenoid solvent valve to stop solvent flow into the wheel housing; and b. transmitting an ozone signal from the controller to open a solenoid ozone valve to inject ozone into the wheel housing.

20. The method of claim 19, wherein the step of varying ozone production comprises the steps of:

a. determining an ozone level by the controller in the wheel housing; and b. transmitting a production signal from the controller to vary the ozone production from the ozone generator.

21. The method of claim 20, wherein step of varying ozone production comprises the step of activating manually an ozone control means wired to the ozone generator to manually vary the ozone production.

22. The method of claim 21, wherein an ozone fan located in the ozone generator circulates air into the wheel housing after termination of the ozone production to further reduce ozone off gassing left inside the wheel housing.

23. A method of using an ozone injection system to inject ozone after a solvent cycle in a closed loop to a dry cleaning machine and to draw residual gases off the dry cleaning machine, the method comprising the steps of:

a. connecting a transfer line to an existing nipple on a dry cleaning machine, the existing nipple being machined into a wheel housing of the dry cleaning machine;

b. injecting ozone after a solvent cycle has terminated from an ozone generator by an ozone injector assembly;

c. transmitting a solenoid solvent signal from a controller to close a solenoid solvent valve on the ozone injector assembly to terminate solvent flow into the wheel housing;

d. transmitting solenoid ozone signal from the controller to open a solenoid ozone valve on the ozone injector assembly to begin ozone flow;

e. varying ozone production from the ozone generator corresponding to contamination of the load of articles to be dry cleaned, the ozone production attacking the solvent;

f. terminating ozone flow while maintaining air flow from a cooling fan into the wheel housing; and g. opening a door of the wheel housing to unload the load of articles while allowing any heavier than air solvent gas residue to gravitate outside the wheel housing toward a floor surface.

24. The method of claim 23, wherein the ozone generator is activated the ozone production to draw the solvent gas residue which has gravitated near the floor surface into the ozone generator to merge the ozone with the solvent residue gas to purge the same.

* * * * *